US005145342A

United States Patent [19]

Gruber

[11] Patent Number: 5,145,342

[45] Date of Patent: Sep. 8, 1992

[54] STATOR FOR ECCENTRIC SPIRAL PUMP

[75] Inventor: Heinz Gruber, Seesen/Rhüden, Fed. Rep. of Germany

[73] Assignee: Go-Anker GmbH, Seesen/Rhüden, Fed. Rep. of Germany

[21] Appl. No.: 662,108

[22] Filed: Feb. 27, 1991

[30] Foreign Application Priority Data

Mar. 1, 1990 [DE] Fed. Rep. of Germany ..... 40063399

[51] Int. Cl.[5] ..... F04C 2/107; F04C 5/00

[52] U.S. Cl. ..... 418/48; 418/153

[58] Field of Search ..... 418/48, 153, 178

[56] References Cited

U.S. PATENT DOCUMENTS 2,527,673 10/1950 Byram ..... 418/48

3,499,389 3/1970 Seeberger et al. ..... 418/48

FOREIGN PATENT DOCUMENTS 1553199 1/1971 Fed. Rep. of Germany .

2713468 9/1978 Fed. Rep. of Germany ..... 418/48

3304751 8/1985 Fed. Rep. of Germany .

*Primary Examiner*—John J. Vrablik

*Attorney, Agent, or Firm*—Michael J. Striker

[57] ABSTRACT

A stator for an eccentric spiral pump has a metallic casing, and an insert located inside the metallic casing. The insert is formed as a coating of a rubber-elastic material with a uniform layer thickness and has inner surface with a thread-like profile.

13 Claims, 4 Drawing Sheets

Fig.

STATOR FOR ECCENTRIC SPIRAL PUMP

BACKGROUND OF THE INVENTION

The present invention relates generally to stators for eccentric spiral pumps.

More particularly, it relates to a stator for an eccentric spiral pump, which has a thread-like profile on its inner surface and includes a metallic casing and an insert of a rubber-elastic material in the casing.

Eccentric spiral pumps are known in many forms and serve to deliver, for example, solid/liquid mixtures such as for example mortar, mud or the like. They include a stator which is provided with a thread-like profile on its inner surface and composed of a rubber-elastic material, and a rotor which is composed of steel and has a thread-like profile on its outer surface and rotates eccentrically. Delivery chambers for the medium to be delivered are formed between the threaded profiles of the stator and the rotor. The chambers are sealed off from one another and moved in the delivery direction during rotation of the rotor so as to change continuously their shape and position, but not their volume during the movement. The pressures or delivery heads achievable on the outlet side depend substantially on the quality of the seal between the delivery chambers and hence, inter alia on the rigidity or dimensional stability of the rubber profile of the stator. The latter is usually adjusted by way of certain initial stress that is the difference in diameter between the rotor and the stator. A comparatively softer rubber material in the frame of the stator profile is considered to be more wear-resistant than a relatively harder one. However, the former requires substantially higher initial stress to achieve the same outlet pressure, such that, since rubber should be considered as incompressible material the result would be comparatively marked deformations of the stator profile.

There are limits to increasing the initial stress with the aim of increasing the outlet pressure both with regard to the necessary torque and with regard to the wear which occurs. This wear has an effect inter alia, on the steel rotor. The steel rotor commencing on the pressure side and continuing in the direction of the suction side, becomes worn and its dimensions finally take on the shape which tapers in general conically toward the pressure side. This gradual material wear results in a continuously decreasing initial stress and sealing effect between the delivery chambers, and hence a reduction in the achievable delivery head. Increasing performance by increasing speed would not be useful either, in view of the wear to be expected and the energy requirements.

Stators for eccentric spiral pumps conventionally have a cylindrical metal casing and an insert introduced in the casing by an injection process and made of rubber material. The insert has on the inside the shape of for example a double-threaded profile intended for cooperating with the rotor. It is known that in rubber materials the amount of shrinkage to be expected is dependent upon the respective wall thickness of the profile. With regard to achieving low production tolerances special additional measures therefore are required in order to meet the tolerances despite the locally varying wall thickness which are attributable to the threaded profile.

German reference DE-AS 1,553,199 discloses a readjustable stator for an eccentric spiral pump. In the stator the insert composed of an elastic material is located in a metallic casing, the diameter of which is reducable so that any wear occuring can be compensated within a certain scope by way of a reduction in diameter. Problems arise however in the precise adjustment of the respective initial stress required which at least when used on building sites where this is at all possible, means a considerable outlay.

In order to reduce the friction power losses caused by the initial stress between the stator and the rotor, it was proposed in the German document DE-PS 3,304,751 to continuously reduce the effective dimensions of the stator starting from its suction side up to its pressure side. In conjunction with the rotor which, as seen in the axial direction has the same radial dimensions, maximum initial stress is available here on the pressure side. In this way a reduction in torque can be achieved.

SUMMARY OF THE INVENTION

Accordingly, it is an object of the present invention to provide a stator for an eccentric spiral pump of the above mentioned general type, which in a simple manner avoids the disadvantages associated with the prior art with respect to a longer service life, high performance and/or reduced expenditure of energy.

In keeping with these objects and with others which will become apparent hereinafter, one feature of the present invention resides, briefly stated, in a stator in which the casing of at least a part of the length of the stator has the insert formed by a coating of a rubber elastic material with a uniform layer thickness and having an inner thread-like profile.

In accrodance with the present invention the entire threaded profile lining the inside of the stator and/or the insert located here is characterized by uniform wall thickness of rubber material, such that there is practically the same amount of shrinkage at any location of the stator lining. The low dimensional tolerances which are attributable to a construction suitable for production bring with them a simplification of the manufacturing process. The respective layer thickness of the inserts may be selected as small as possible, starting from the required initial stress, the elasticity of the material and the permissible degree of wear. Since the material costs for example of crude rubber on the one hand and the steel or iron on the other hand differ considerably, the stator according to the present invention is characterized by significant saving in the relatively expensive rubber material. Since worn stators are always thrown away as a whole and there is practically no recycling of the rubber material available, the design in accordance with the invention makes contribution to waste disposal.

The small layer thickness of the rubber inserts correspondingly result in small possible deformation paths, which in conjunction with the profile design of the casing and/or the metallic windings embedded in the rubber material have the effect that a strong stiffening of the rubber profile is effected even in the event of comparatively small deformation paths. Therefore, correspondingly high resistance with respect to stresses on the pressure side is obtained. These important points are applicable to the same degree to relatively soft rubber materials, the deformation of which is also impeded by the profiling of the casing core by the windings. In this case too, due to the incompressibility of the rubber, the result is a strong stiffening, in particular in the region of the sealing surfaces of the above mentioned delivery chambers. When relatively hard rubber materials are used, maximum output pressures can be achieved.

In accordance with another embodiment of the invention, only a part of the stator length is formed so that the above mentioned small uniform layer thickness of the rubber material is obtained, whereas the remaining residual part of the stator may be formed in the conventional manner. In this latter part a conventional insert is thus provided without the above mentioned system of metallic windings or a smooth-walled cylindrical casing part. If conventional steel rotors are used, in this way different deformabilities are achieved in the resulting two portions of the stator in such a way that on the pressure side an extra high degree of rigidity and hence of sealing effect is permanently available.

This system naturally can be formed in numerous ways. For example, by virtue of the appropriate dimensioning of the cross-section of the interpollated winding or the deformation of the casing. Also, more than two portions can be made available in the course of one stator length. These portions are characterized by varying the deformability of the rubber material, namely to the effect that the result is a stepwise increasing rigidity from the suction side to the pressure side.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
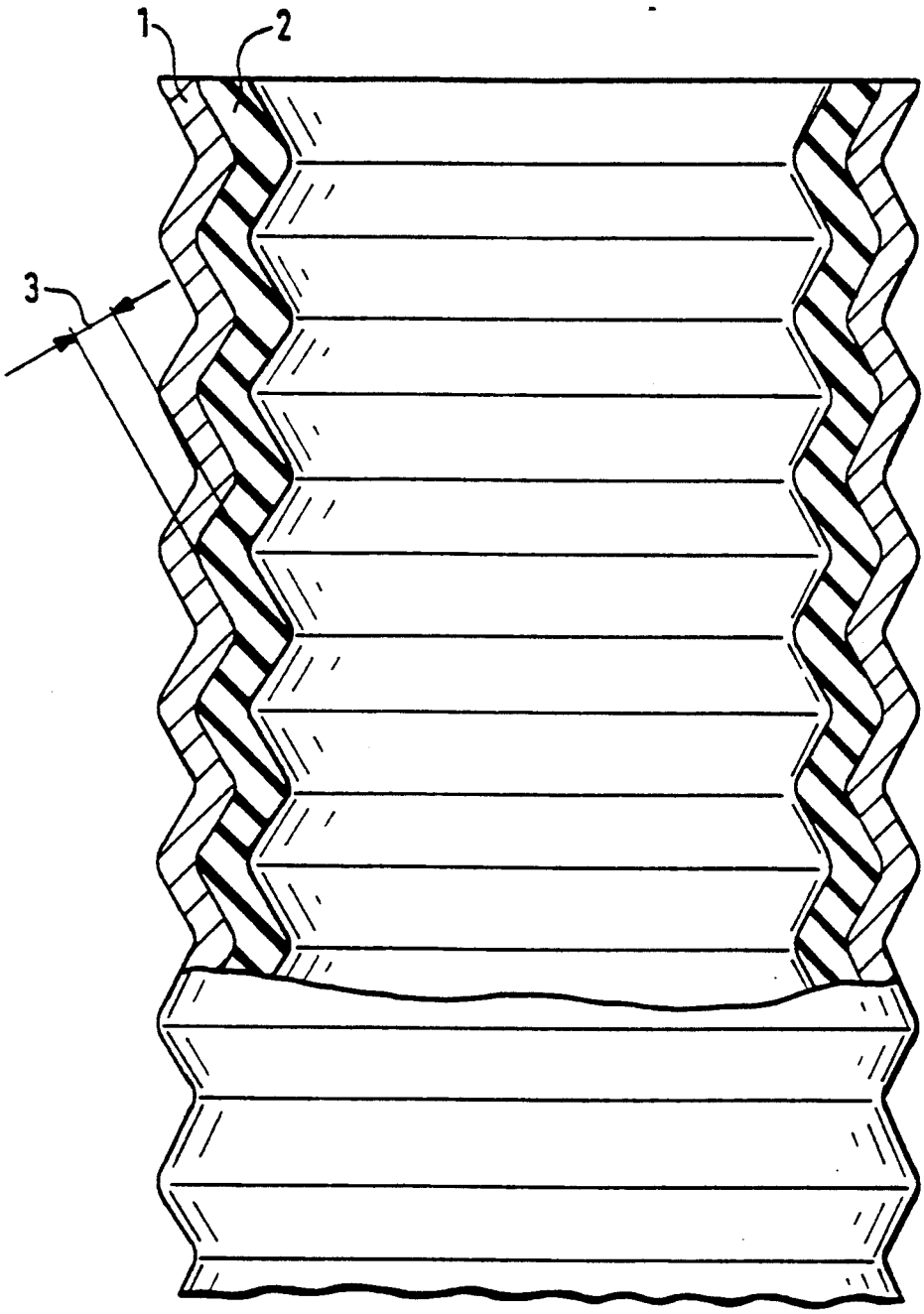
FIG. 1 is a view showing an axial section of a stator for forming an eccentric spiral pump in accordance with the present invention.

A stator for eccentric spiral pumps in accordance with the present invention has a casing which is identified with reference numeral 1. The casing 1 is composed of steel and has a contour which is formed for example in the manner of a dual-thread coarse thread. The threaded profile can be produced by any desired process. An insert 2 is arranged on the inner side of the casing 1. The insert 2 is composed of a rubber-elastic material. It is preferably undetachably connected, for example vulcanized to the inner surface of the casing 1. The insert 2 is dimensionsed so that the entire inner surface of the casing 1 is covered with the layer of a uniform thickness 3. This produces on the inside of the casing 1 a contour which is made of the rubber-elastic material and shaped as the dual-turn thread to be used as a pump stator.

The layer thickness 3 should be at least 5 mm, while given an acceptable wear of 2 mm. This comparatively small layer thickness provides a number of advantageous effects in conjunction with the profiled shape of the casing 1.

It is known that the outlet pressure and therefore its delivery head which can be reached in eccentric spiral pumps depend decisively on the quality of the seal of the delivery chambers for the respective medium, which are formed between the threaded profiles of the rotor and stator. This seal is conventionally made by a certain amount of initial stress between the rotor made of steel and the rubber elastic material of the stator windings, and results in a certain amount of deformation of the stator profile in the region of the seals of the delivery chambers. The purposes of this deformation is to increase the deformation resistance because of the stresses arising on the pressure side. Due to the small layer thickness of the rubber elastic material in accordance with the present invention, comparably small possible deformations are obtained in conjunction with support effects of the thread-like deformed casing 1. These deformations are such, that given the same pressure resistance or the same achievable outlet pressure, the extent of the initial stress between the rotor and the stator may be smaller than in the conventional eccentric spiral pumps. Thus, the profiling of the casing 1 in particular acts in a stiffening manner or so as to increase deformation resistance, which gives the inner profile of the stator a uniform supporting effect over its entire length.

Since possible deformations of the rubber material are limited in this way in a constructional manner it is possible to use a more wear-resistant soft rubber without, as would otherwise be necessary, having to generate excessively high initial stress forces to achieve the required pressure resistance.

The use of a comparatively hard rubber material in the frame of the stator profile on the other hand makes it possible to achieve high outlet pressures despite low initial stress forces. Because of the homogenous layer thickness on the inside of the casing 1, it is also possible in a very simple manner to considerably improve manufacturing accuracy compared to the known pump stators. This is due to the fact that a substantially uniform degree of shrinkage can be assumed, and extensive additional methods for compensating a non-uniform way of shrinkage due to uneven wall or layer thicknesses of the rubber material can be dispensed with.

The pump stator shown in FIG. 1 can be manufactured in a known manner. Starting from a correspondingly profiled casing 1, in each case using a core which is appropriately profiled on the outside, the substance of the rubber-like material is injected. It can be seen that because of the profiled design of the casing 1, the adhesion between the casing and the rubber-like material is improved, in addition to adhesion and vulcanizing, by a certain form fit. Comparatively small layer thickness 3 may be used. This results in a simple manner in addition to small dimension tolerances, in a high resistance to deformation of the system including the insert 2 and the casing 1.

Figure 2:
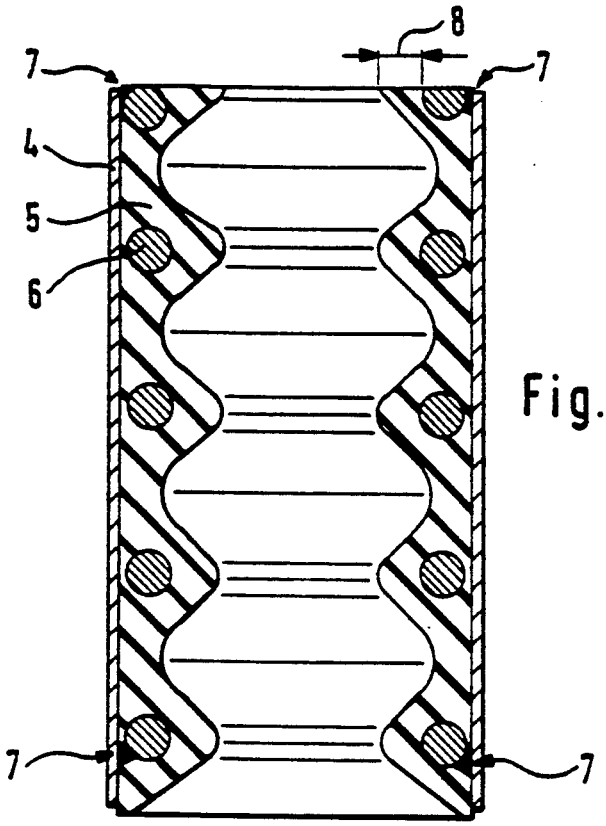
FIG. 2 is a view showing an axial section of the stator in accordance with another embodiment of the present invention.

FIG. 2 shows a stator in accordance with a further modification of the present invention. The stator has a smooth cylindrical casing 4 which is composed of steel. An insert 5 composed of a rubber-elastic material is accommodated in the casing 4. The stator additionally has a system of windings which are made of steel wires and identified with reference numeral 6. The steel wires 6 are adapted to the shape of the windings of the insert 5, so as to form for example the shape of a dual-thread coarse thread. The steel wires 6 are welded to the casing 4 on one or both front ends with welding seams identified with reference numeral 7.

The windings 6 are completely embedded in the rubber elastic material in such a way, in relation to the inside of the casing 5, that the rubber material has substantially uniform layer thicknesses 8.

As shown in this embodiment the windings 6 have steel wires of a circular cross-section. Naturally, the cross-sectional shape of the steel wires can be adapted to the cross-sectional shape of the individual thread turns of the threaded profile, in order to make the layer thickness of the rubber uniform. It can be seen that due to the complete embedding of the windings 20 in the rubber elastic material, corrosion problems are avoided. The insert 5 is advantageously undetachably connected to the casing and for example is vulcanized to it. The advantages resulting from the uniform or substantially uniform layer thickness of the rubber material correspond to the advantages of the embodiment of FIG. 1 and reference is made in this respect to the remarks connected therewith.

Figure 3:
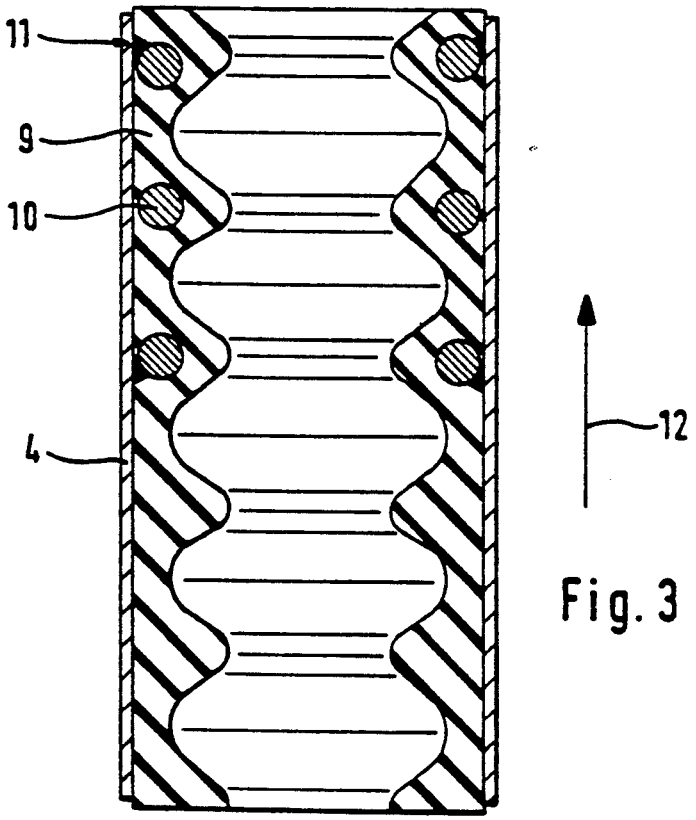
FIG. 3 is an axial section of the stator in accordance with still a further embodiment of the present invention.

A further embodiment of the stator in accordance with the present invention is shown in FIG. 3. The stator has a smooth cylindrical casing 4 and an insert 9 composed of a rubber-elastic material. The insert 9 can be divided into two portions, namely a first portion provided with a system of windings 10 composed of steel wire, and a second portion which does not have any wiring or other reinforcements of a comparable function. The ends of the windings 10 are welded to the casing 4 by weld seams identified with reference numeral 11. The insert 9 is connected to the casing 4 in the same way as in the above described embodiments. It is again endeavoured as in FIG. 2 to achieve the most uniform layer thickness possible of the rubber material by placing the windings 10 in this portion of the stator.

The direction of delivery of the stator is identified with the arrow 12. By dividing the stator into the above mentioned two portions, substantially less possible deformation of the rubber material is obtained in the first portion provided with the winding than in the second portion. On the pressure side, following insertion of a rotor, there is substantially greater stiffening and hence pressure resistance of the rubber material, and a good seal of the individual delivery chambers formed between the windings of the rotor and the stator. On the suction side, however, the initial stress is smaller because of the prevailing larger layer thicknesses and hence the greater deformability of the rubber material. This however presents no problems since in this region only small pressure differences occur between the individual delivery chambers, and the quality of the seal of the delivery chambers in this portion is of secondary importance only. By thus restricting the high pressure resistance to the region of the stator in which it is of importance to the necessary seal and hence to the delivery head achievable, the torque to be applied during operation of the eccentric spiral pump is at the same time noticeably reduced with respect to an embodiment in which a uniform initial stress is set over the entire length.

Figure 4:
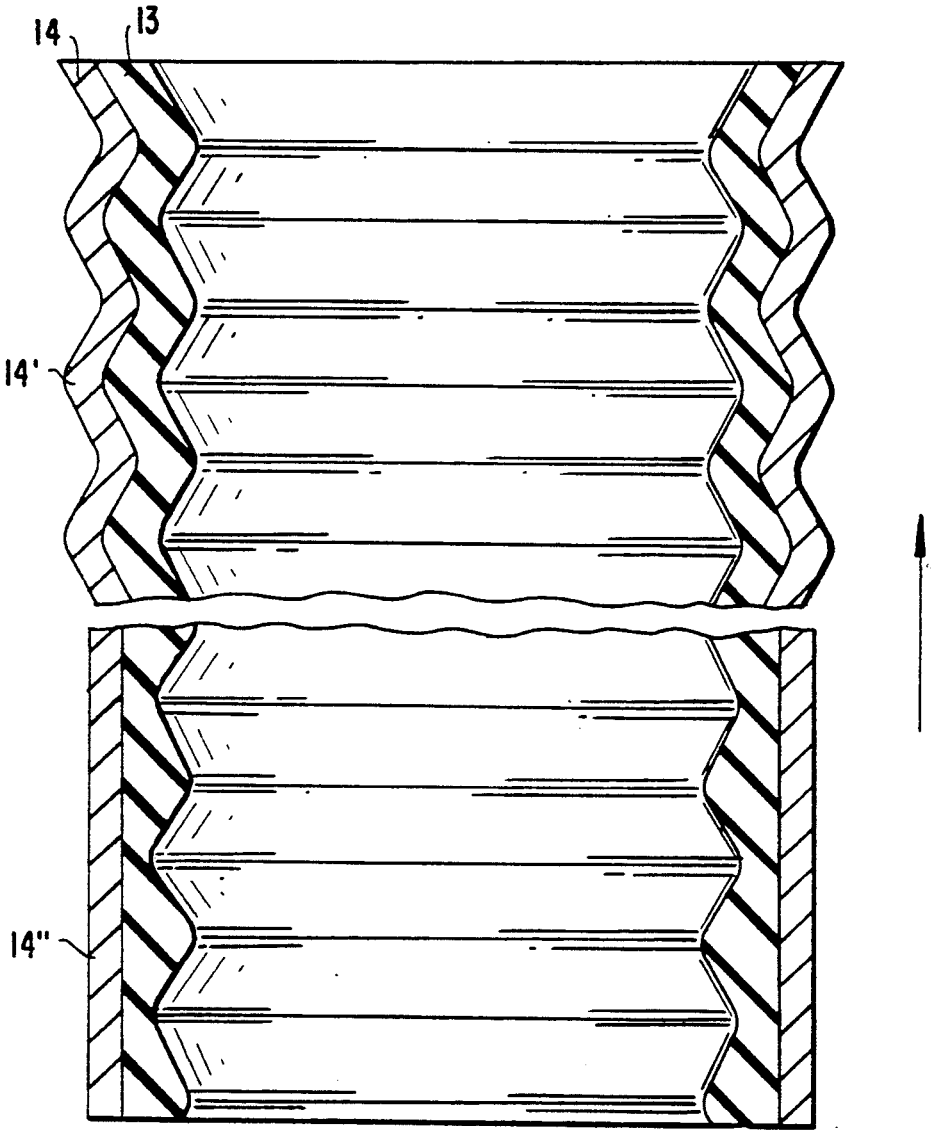
FIG. 4 is an axial section of the stator in accordance with an additional embodiment of the present invention.
Figure 5:
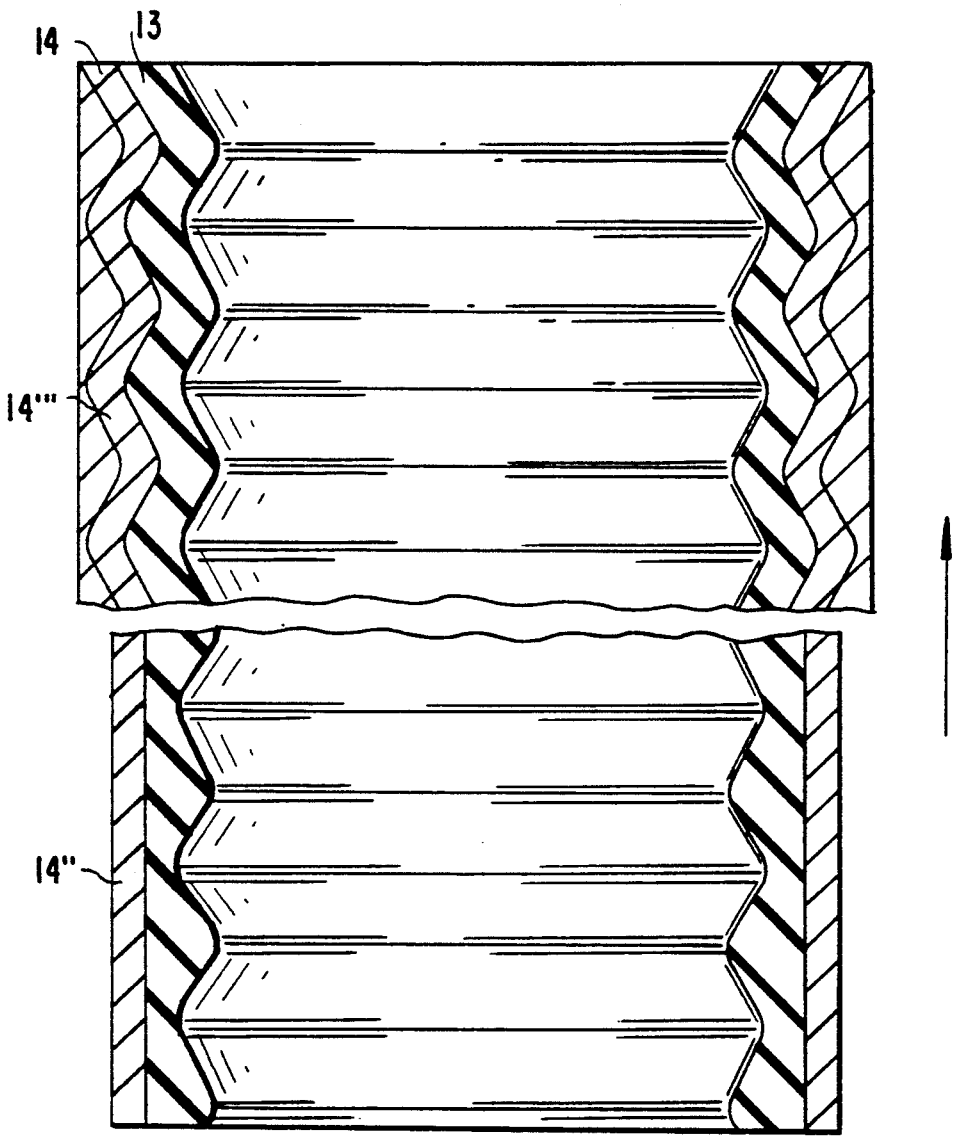
FIG. 5 is an axial section of the stator in accordance with yet an additional embodiment of the present invention.

The stator can also have a casing 14 with one surface part 14' provided with a thread-like profile and another surface part 14'' provide with a cylindrical inner surface as shown in FIG. 4. An insert 13 has an outer surface corresponding to the inner surface of the casing 14 and an inner surface with a thread-like profile. As shown in FIG. 5, the stator can also have one surface part 14''' with the thread-like profile only on its inner surface.

The portion of the stator which is provided with the steel wire reinforcements or windings in accordance with the present invention can constitute approximately 50% of the length of the entire stator.

In all shown embodiments, non-adjustable stators are used, so that they are very easy to operate, and in particular on the building site end.

It will be understood that each of the elements described above, or two or more together, may also find a useful application in other types of constructions differing from the types described above.

While the invention has been illustrated and described as embodied in a stator for an eccentric spiral pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A stator for an eccentric spiral pump, comprising a metallic casing; an insert located inside said metallic casing, said insert being formed as a coating of a rubber-elastic material and having an inner surface with a thread-like profile; and a plurality of windings which are embedded in said insert and reproduce said thread-like profile of said insert.

2. A stator as defined in claim 1, said casing having an inner surface and being not adjustable, said insert being vulcanized on said inner surface of said casing.

3. A stator as defined in claim 1, wherein said windings are composed of a metallic material.

4. A stator as defined in claim 1, wherein said casing has an inner surface, said windings are connected at least in part to said inner surface of said casing.

5. A stator as defined in claim 4; and further comprising means for connecting said windings to said inner surface of said casing and including welding seams.

6. A stator as defined in claim 1, wherein said thread-like profile of said windings has a cross-sectional shape corresponding to a cross-sectional shape of said thread-like profile of said insert so as to provide a uniform layer thickness of said insert.

7. A stator as defined in claim 1, wherein said windings extend over only a part of a length of the stator.

8. A stator as defined in claim 7, wherein said windings extend over substantially 50% of the length of the stator.

9. A stator for an eccentric spiral pump, comprising a metallic casing; an insert located inside said metallic casing, said insert being formed as a coating of a rubber-elastic material and having an inner surface with a thread-like profile, said casing having an inner surface with one surface part provided with a thread-like profile and another surface part having a cylindrical inner surface.

10. A stator as defined in claim 9, wherein said casing in the region of said one surface part has said thread-like profile only on its inner surface.

11. A stator as defined in claim 9, wherein said casing in the region of said one surface part is deformed through so as to provide said thread-like profile.

12. A stator as defined in claim 9, wherein said other surface part with a cylindrical inner surface extends over substantially 50% of a length of the stator.

13. A stator as defined in claim 9, wherein said insert has a uniform layer thickness in the region of said one surface part.

* * * * *

UNITED STATES PATENT AND TRADEMARK OFFICE

CERTIFICATE OF CORRECTION

PATENT NO. : 5 145 342

DATED : September 8,1992

INVENTOR(S) : Heinz Gruber

It is certified that error appears in the above-identified patent and that said Letters Patent is hereby corrected as shown below:

On the title page, the name of the assignee should read

-- GD-Anker GmbH --

Signed and Sealed this

Twenty-ninth Day of March, 1994

Bruce Lehman

*Attest:*

BRUCE LEHMAN

*Attesting Officer*

*Commissioner of Patents and Trademarks*